US009691516B2

(12) United States Patent
Baxter

(10) Patent No.: US 9,691,516 B2
(45) Date of Patent: Jun. 27, 2017

(54) PERSONAL ELECTROMAGNETIC HYGIENE SLEEP SYSTEM

(71) Applicant: John R Baxter, Winter Park, FL (US)

(72) Inventor: John R Baxter, Winter Park, FL (US)

( * ) Notice: Subject to any disclaimer, the term of this patent is extended or adjusted under 35 U.S.C. 154(b) by 24 days.

(21) Appl. No.: 14/755,351

(22) Filed: Jun. 30, 2015

(65) Prior Publication Data

US 2017/0000271 A1 Jan. 5, 2017

(51) Int. Cl.

| | |
|---|---|
| ***D03D 25/00*** | (2006.01) |
| ***H01B 1/04*** | (2006.01) |
| ***A47C 31/10*** | (2006.01) |
| ***A47C 31/00*** | (2006.01) |
| *A47G 9/02* | (2006.01) |
| *H01R 4/06* | (2006.01) |

(52) U.S. Cl.
CPC ..... *H01B 1/04* (2013.01); *A47C 31/004* (2013.01); *A47C 31/105* (2013.01); *A47G 9/0246* (2013.01); *H01R 4/06* (2013.01)

(58) Field of Classification Search
CPC ..... A47G 9/00; D03D 25/00
USPC ..... 5/484, 500–502; 139/420 R, 425 R
See application file for complete search history.

(56) References Cited

U.S. PATENT DOCUMENTS

| | | | | |
|---|---|---|---|---|
| 620,679 | A | 3/1899 | Shryock | |
| 1,607,140 | A | 11/1926 | Wappler | |
| 3,211,153 | A | 10/1965 | Gambetti | |
| 4,255,487 | A * | 3/1981 | Sanders | D02G 3/445 427/122 |
| 5,448,840 | A | 9/1995 | Cheskin | |
| 5,715,536 | A | 2/1998 | Banks | |
| 6,804,848 | B1 * | 10/2004 | Rose | A47C 27/082 5/706 |
| 2004/0098064 | A1 * | 5/2004 | O'Kelly | A61N 1/205 607/48 |
| 2006/0234903 | A1 * | 10/2006 | Short | D06M 13/192 510/526 |
| 2007/0277323 | A1 * | 12/2007 | Bain | A47C 27/006 5/699 |
| 2008/0202623 | A1 * | 8/2008 | DeAngelis | D06N 3/0086 139/425 R |

* cited by examiner

*Primary Examiner* — Fredrick Conley

(57) ABSTRACT

A personal electromagnetic hygiene sleep system for calibrating a human to a baseline bio-electric homeostasis with the human and the environment via stimulus-responsive and performance textiles. These textiles possessing tested and theoretical benefits to the human organism such as: Harnessing the Earth's electrically negative potential via the Earth's mobile and free electrons to be an agent that assist in canceling, reducing, or pushing away electric fields from the body as well as serving to help attenuate oxidative stress and damage to the body from positively charged Reactive Oxygen Species (Free Radicals). Conference of these benefits are effected via a person being in direct or field contact with certain stimulus-responsive performance textiles and a plurality of adjacent conductive fibers for the transport of free electrons to the body from a greater electrically negative potential, an electrical ground, via the ground potential in a standard wall outlet. All superimposed upon a mattress.

5 Claims, 6 Drawing Sheets

PERSONAL ELECTROMAGNETIC HYGIENE SLEEP SYSTEM

FIELD OF THE INVENTION

The present invention relates generally to novel composite constituents and textile materials including such novel composite constituents having been altered utilizing Surface Modifying Systems (SMS) and implanting processes to a textile substrate to produce stimulus-responsive and performance textiles. Resultant compositions may interact with the waveforms of energy and electromagnetic energy beyond the visible spectrum as well as the human body when in direct or field contact. More specifically, the present invention relates to deployment of these stimulus-responsive and performance textiles designed to interact with the human body, its needs, necessities and homeostasis mechanisms deployed in an electromagnetic hygiene sleep system for the purpose of coupling the Earth's electrically negative potential via the Earth's mobile and free electrons to a human so as to be an agent that cancels, reduces, or pushes away potentially harmful electric fields from the body as well as serving to attenuate oxidative stress and damage to the body from positively charged Reactive Oxygen Species (Free Radicals).

BACKGROUND OF THE INVENTION

Since the Industrial Age, protecting electronics from Electro Static Discharge (ESD), Electro Magnetic Frequency (EMF) and aberrant fluctuations in charge is considered a best practice. An abundance of patents surrounding the ESD industry exist, even pre-dating those of the $20^{th}$ century, U.S. Pat. Nos. 620,679; 1,607,140 and 3,211,153 serving as examples to same. Until recently, little thought has been given to biological effects EMF and aberrant fluctuations in charge existing primarily as subliminal or "below threshold" stimuli have on the human organism. Such stimuli have been shown to have known deleterious effect on the body, some with unknown long term ramification. Recent studies continue to emerge illustrating that in addition to protection from ESD, placing a human in conductive contact with the electrically negative potential of the Earth has measurable physiological impact and consequence to health. Numerous patents and published patent applications discuss prior art, multifunctional performance polymer fiber constituents in textile and textile application for the purpose of electrical conduction as well as conductively connecting a human to an electrical ground. Examples of such multifunctional performance polymer fiber materials in textile and textile application are described in U.S. Pat. Nos. 5,448,840; 5,715,536; 6,210,771 and 8,394,296, each of which is incorporated herein by reference. Current art is being deployed primarily for the protection of electronic devices, with little regard as to how these technologies can be employed to confer similar and analogous benefit to humans. Discovery of new and novel ways to "cleanse" ourselves of the injurious and deleterious stimuli of EMF and aberrant electrical charge has become the basis of a new field of study, "electromagnetic hygiene." It is desirable to deploy art of this nature, these materials, like materials and their functionality in a more specifically purposed and comprehensive personal electromagnetic hygiene sleep system for the purpose of calibrating the human to a baseline bio-electric homeostasis with itself and the environment via the combination of stimulus-responsive, performance and responsive textiles with ESD technology and the like; harnessing the Earth's electrically negative potential via the Earth's mobile and free electrons to be an agent that cancels, reduces, or pushes away electric fields from the body as well as serving to attenuate oxidative stress and damage to the body from positively charged Reactive Oxygen Species (Free Radicals).

Nowhere within the prior art employs such a specific synergistic and complimentary merging of the aforementioned and subsequently referenced multipurpose stimulus-responsive and performance textiles and technologies for utilization in a comprehensive personal electromagnetic hygiene sleep system for the purpose of calibrating the human to a baseline bio-electric homeostasis with itself and the environment thereby conferring numerous health and physiologic benefits and protections been disclosed, utilized or fairly suggested.

Since the Industrial Age, protecting electronics from ESD, EMF, and aberrant fluctuations in charge is considered a best practice. Until recently, little thought has been given to biological effects such subliminal or "below threshold" stimuli have on the human organism. Such stimuli have been shown to have known deleterious effect on the body as well as harboring unknown long term ramification. Possible benefits may arise from application of electrostatic and other "electromagnetic hygiene" measures in hospitals, the manufactured environment and in the home. Research indicates that the human body when placed in direct or field contact with the Earth attains electrical equilibrium with the electrically negative potential of the Earth; thereby calibrating the human to a baseline bio-electric homeostasis with itself and the environment significantly "normalizing" biological functioning. Deploying mechanisms to "cleanse" ourselves of these harmful and damaging stimuli has become the basis of "electromagnetic hygiene."

There exists a hidden danger to biological life so pervasive, so prevalent and so omnipresent in today's world, it is seemingly inescapable. What's worse is that this hazard is so covert in its attack, most of us are never even aware of its existence. Subliminal stimuli or "below threshold stimulatory mechanisms," are those sensory stimuli below a person's threshold for conscious perception. Recent reviews of functional magnetic resonance imaging (fMRI) studies illustrate that as subliminal stimuli (such as ambient EMF) occurs, they activate specific regions of the brain [and body] in the absence of our conscious awareness. Subliminal activation of the stress response (the adrenocortical reaction) is one of the most important deleterious effects that EMFs and nonionizing radiation have upon life in general, but is far from the only effect; how these stimuli affect us individually and adversely in the absence of our knowledge are of greatest concern. Discovering and deploying mechanisms to "cleanse" ourselves of these harmful and damaging stimuli are of greatest significance if man is to continue forward. Waveforms unfamiliar to the human organism can and often do result in bio-hazards leading to aberrant alterations in physiologic function and the ensuing sequela, such as the proliferation of Reactive Oxygen Species (ROS) and Free Radicals. Many of these physiologic alterations are associated with the body's stress response (the fight or flight mechanism) as well as disruptions to the central nervous, cardiovascular, endocrine and growth control systems. Recent studies and reports suggest that the marked rise in chronic and inflammatory diseases may be the result of manufactured environmental factors and of particular concern is the invisible threat of "electromagnetic pollution."

For the lot of us living in the throes of the industrialized environment, we are enveloped in the cloud of an unrelenting electromagnetic fog. From the cars we drive, the cell phones we use, even down to the tablet you plug into the wall and place next to your bed at night; the electromagnetic nature of the industrial environment has become as ubiquitous to our lives as sleeping. It is only until very recently that any thought has been given to the possible advantages of creating electromagnetic microenvironments more closely resembling those found in nature or developing biologically-friendly technologies aligned more closely to nature's operating principles. Human exposure to a variety of well documented, studied and naturally occurring electromagnetic phenomena, introduced into the manufactured environment, appear to garner possible human benefit. Measures such as these for the purpose of reaping obtainable health, wellness and possibly medical benefit via the introduction of said phenomena through technology, has been referred to as "electromagnetic hygiene".

Ubiquitous to our environment is a long established favorable and largely disregarded wellspring of beneficial, naturally occurring components available for application in the fields of human health, wellness and medicine. These beneficial elements are simply mobile and free electrons produced by what has been identified as literally a Global Atmospheric Electrical Circuit of the Earth; and as such, the Earth's surface houses a limitless and continuously renewable supply of mobile and free electrons. For purposes of this discussion, it is helpful to recognize that the surface of the planet is (for the most part) electrically conductive relative to entities in direct or field contact with it.

From the dawn of mankind till very recently in human history, it appears the human organism was designed or evolved to be in near constant direct or field contact with the Earth, and as such, it's mobile and free electrons. As the result of this intimate connection between man and the environment, the Earth's free electrons were able to enter the body, itself electrically semi-conductive. As the result of this interaction, every part of the body could attain electrical equilibrium with the electrically negative potential of the Earth, thereby constantly calibrating (theoretically) the human to a baseline bio-electric homeostasis with itself and the environment.

This near constant bio-electrical rectification between the human and the electrically negative potential of the Earth has been suggested as being at the very least beneficial to the human organism and by some, as critical to our optimum health presentation. As far back as the turn of the last century, literature supports the re-connection of the human organism with the Earth [and its electrically negative potential] through direct contact like walking barefoot. Further research into so called "lost" clinical practices illustrates investigation of enhancing sleep by connecting the patient to the [electrically negative potential of the] ground utilizing the mechanisms of the day.

Our contemporary and technologically advancing civilizations have served to increasingly separate man from calibrating to the Earth's electrically negative potential via its mobile and free electrons. Ever the double-edged sword, technology and our quest for better living through chemistry has created both boons and boondoggles for man. The use of synthetic and insulating materials inherent to our existence [as well as the dynamics of our existence] has effectively segregated us from the Earth's ambient energy and electrically negative potential. For the most part, because of synthetically soled shoes and the manufactured environment, humans exist in a state of near perpetual levitation above the surface of the electrically negative potential of the Earth and as such are disconnected from the benefits that may be conferred from same. This insulation from the corrective calibration to the Earth's electrically negative potential results in a failure to appropriately to shield humans from EMF with a Feynman electro-protective "umbrella".

Electric fields introduced to the body have been implicated as a factor contributing to potential health consequences in daily life. It's true, substantial debate exists as to the extent electromagnetic fields in our daily surroundings pose a risk to health, but there is no question that the body reacts (often adversely) to EMF stimuli. The "umbrella" effect of the Earth's electrically negative ground potential and the Earth's role in protecting the body is best explained by Nobel Prize winning Physicist Richard Feynman in his famous lectures on electromagnetism. Dr. Feynman expresses that when a human's electrical potential comes in contact with and becomes analogous to the Earth's own negatively electrical potential, the body becomes a de-facto extension of the Earth's own gigantic electric system. The Earth's electrically negative potential [via its mobile and free electrons] turns out to be an "agent that cancels, reduces, or pushes away electric fields from the body".

Studies support that when a human's electrical potential comes in contact with the Earth's own negatively electrical potential, that person's electrical potential itself becomes equalized with the Earth's electrical potential via a transfer of free and mobile electrons from the Earth to the body. This phenomenon has in turn been shown to attenuate the 60 Hz mode from a producing alternating current (AC) electric potential along the surface of the body. This 60 Hz mode common to the manufactured and household environment has been implicated in producing aberrant agitations of the inherent electric charges of the body's electro and biochemistry. This same study sustained the "umbrella effect" described above illustrating that the body of a properly calibrated and connected person is not as electrically susceptible to the agitation of EMF to the body's systems. There is no question that the body reacts to the presence of environmental electric fields and studies demonstrate that the above strategies serve to essentially eliminate ambient voltage induced on the body from common electrical sources.

Accordingly, as we go throughout our lives bathed in a haze of electromagnetic fog, there exists a critical need for a personal electromagnetic hygiene sleep system assisting in recalibrating the human to a baseline bio-electric homeostasis with itself and the environment thereby serving as an agent that cancels, reduces, or pushes away electric fields from the body and supporting the neutralizing of Reactive Oxygen Species. Such a system should be capable of being used while sleeping, during prolonged periods of sitting as well as being generally available to particular targeted areas of the body. There exist numerous shortcomings, lack of focus, disadvantages and dangers to prior art as related to deployment of current technology to adequately meet the new, ever changing and pressing needs for protection of the human organism from the omnipresent, oppressive, pervasive and potentially deadly dangers from ESD, EMF, and aberrant fluctuations in charge. In addition, there exist no prior art employing the potential synergistic and complementary nature of the aforementioned system in a singular and comprehensive system. The present invention fulfills these needs and provides ancillary advantages.

DETAIL DESCRIPTIONS OF THE INVENTION

All illustrations of the drawings are for the purpose of describing selected versions of the present invention and are not intended to limit the scope of the present invention.

The embodiments set forth below represent the necessary information to enable those skilled in the art to practice the invention and exemplify the best mode of practicing the invention. Upon reading the following description in light of the accompanying drawing figures, those skilled in the art will understand the concepts of the invention and will recognize applications of said concepts not expressly addressed herein. It should be understood that these concepts and applications fall within the scope of the discourse and accompanying claims.

The present invention delineates a fundamental method and system for provision of a personal electromagnetic hygiene sleep system and is generally directed to a system for the purpose of calibrating a human to a baseline bioelectric homeostasis with said human and the environment. This action is accomplished via an apparatus facilitating a human's electrical potential coming in contact with and becoming analogous to the Earth's own negative electrical potential. Such rectification has been shown to have a variety of possible health promoting processes as a human's electrical potential comes in contact with and becomes analogous to the Earth's own negative electrical potential. Of particular importance is that as the semi-conductive nature of the human body comes in contact with the electrically negative potential of the Earth, the human body may become a de-facto extension of the Earth's own gigantic electric system and the Earth's electrically negative potential [via its mobile and free electrons] becomes an agent that cancels, reduces, or pushes away electric fields from the human body.

This stated purpose is accomplished via the integration of the following plurality of technologies comprising multi-functional stimulus-responsive polymers, performance, and responsive textiles placed in direct and/or field contact with the organism. These textiles, while in direct and/or field contact with an organism, possess both clinically proven and theoretical benefits to the human body including enhanced mood, improved sleep cycles, and the attenuation of oxidative stress and damage to the body of the organism from Electro Magnetic Frequency (EMF), waveforms, and positively charged Reactive Oxygen Species (Free Radicals) via a substrate textile and a plurality of adjacent conductive filaments; the substrate textile and the plurality of adjacent conductive filaments facilitating the transport of free electrons to the organism from a relatively greater negative electrical potential, an electrical ground, via the ground potential in a standard wall outlet.

With reference to the accompanying FIG. 1 through 6, the salient features of the preferred embodiments are now explained in detail.

Figure 1:
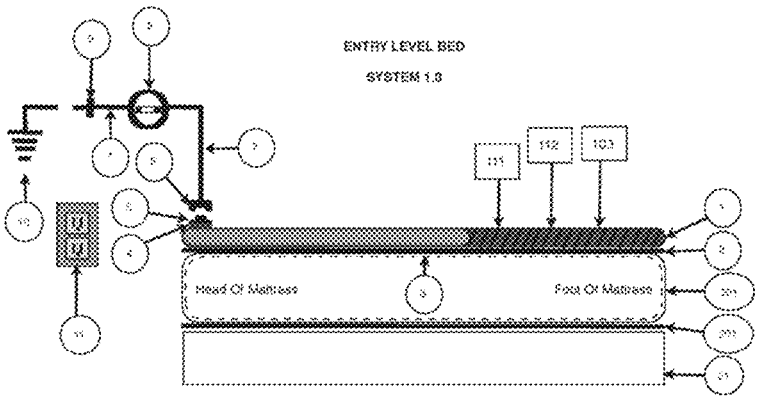
FIG. 1 is a schematic view of a personal electromagnetic hygiene sleep system in a preferred embodiment of the present invention, comprising a washable, breathable, removably fastened multi-layered cover conductively connected to an electrical ground via standard wall socket and having a surge protection device superimposed between said cover and electrical ground, all removably fastened via zipper assembly atop a visco-elastic or functionally analogous mattress and mattress cover. The entirety of the system is set upon an industry standard foundation, appropriate in size to that of each embodiment of the invention's variations being described herein and having specific functional variances' in accordance with and to the various teachings described herein in accordance with those particular embodiments of the invention.

The detailed recitation begins with FIG. 1, depicting a preferred embodiment of the present invention in a schematic view of a personal electromagnetic hygiene sleep system, System 1.0, embodying the present invention. The essential components of System 1.0 comprising a washable, breathable, removably fastened multilayered textile surface 1, integrally associated with an electrically conductive based fiber. Multilayered textile surface 1 is conductively connected to a relatively greater negative electrical potential, an electrical ground 10, via a plurality of conductive textile sewing filaments 111. Said plurality of conductive textile sewing filaments 111, integrally associated with said multilayered textile surface 1. Said plurality of conductive textile sewing filaments 111, mechanically and conductively connected to electrical ground 10, via the electrical ground port in standard wall socket 11, and having an industry standard in-line fast blow fuse assembly employing an industry standard low resistance electrical device 8, that acts as a sacrificial mechanism sufficient to provide over-current protection of the vertebrate organism, in this case a human, superimposed in conductive and mechanical connection in-line between said multilayered textile surface 1, and an electrical ground 10. Multilayered textile surface 1 is integrally associated with a stimulus responsive textile 102, whose plurality of active particles interacts with waveforms of energy and remits beneficial energy to an organism in direct or field contact. Said multilayered textile surface 1 is removably fastened via industry standard zipper assembly, to removable mattress surface 301. Removable mattress surface 301 surrounds a visco-elastic or functionally analogous mattress 3. Embodiments of the entirety of System 1.0 may rest upon an industry standard foundation 21, appropriate in size to that of each embodiment of the system's variations being described herein and having specific functional variances in accordance with and to the various systems described herein with those particular embodiments of the invention.

The following encompasses a detailed presentation of the constituent components and purpose of said components as relating to the accompanying FIG. 2 through 6.

Figure 2:
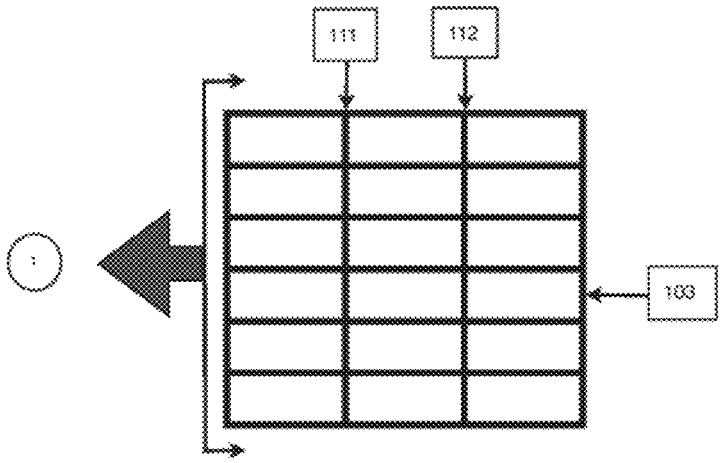
FIG. 2 is an enlarged cut away cross sectional representation of the multi-layered cover and constituent components of a preferred embodiment of the present invention.

Shown in FIG. 2 is an enlarged cut away cross-sectional view of the following areas of FIG. 1. The multilayered textile surface 1 shown in FIG. 1 illustrates a cut away cross-sectional representation of the multilayered textile surface 1 and illustrates the constituent components of the multilayered textile surface 1 as follows. The plurality of conductive textile sewing filaments 111 in FIG. 1 extends through a portion of the multilayered textile surface 1, sufficient for the conduction of free electrons from an electrical ground 10, to within either direct and/or field contact of the organism and said plurality of conductive textile sewing filaments 111, may comprise a diverse plurality of conductive fibers, including, but not limited to, a plurality of carbon based fibrous threads 112. The plurality of carbon based fibrous threads 112 in FIG. 1 extends through a portion of the multilayered textile surface 1, in sufficient percentage so as to affect the requisite transfer of electrons from the electrically negative ground potential to the human in direct or field contact. A substrate 103 for the multilayered textile surface 1 in FIG. 1 consists of a plurality of fibers.

Figure 3:
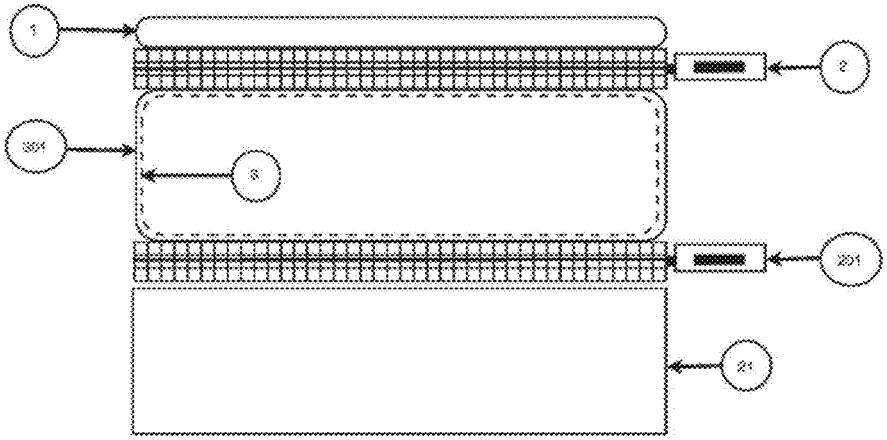
FIG. 3 is an enlarged cut-away cross sectional view of major structural components of a preferred embodiment of the present invention.

Shown in FIG. 3 is an enlarged cut-away cross sectional view of the following areas of FIG. 1. A first zipper assembly 2 in FIG. 1 illustrates an industry standard zipper assembly of sufficient tensile strength and rating as to removably fasten the multilayered textile surface 1 to the removable mattress surface 301. The removable mattress surface 301 surrounds and encloses the mattress 3. A second zipper assembly 201 in FIG. 1 illustrates an industry standard zipper assembly of sufficient tensile strength and rating as to removably secure the removable mattress surface 301 surrounding the mattress 3. In the preferred embodiment, the mattress 3 in FIG. 1 comprises a visco-elastic foam or analogously performing material. The mattress cover 301 in FIG. 1 illustrates a representation of a removable fabric mattress cover surrounding the mattress 3. The foundation 21 in FIG. 1 is industry standard, is appropriate in size to that of each embodiment of the various systems being described herein, and has specific functional variances with and to the various systems described herein with the particular embodiments of the present invention.

Figure 4:
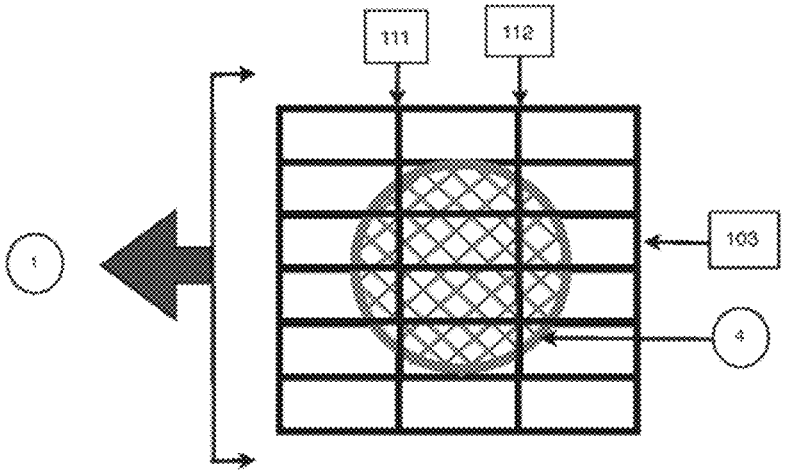
FIG. 4 is an enlarged cut away cross-sectional representation of the multi-layered cover and additional constituent components of a preferred embodiment of the present invention.

Shown in FIG. 4 is an enlarged cut away cross sectional view of the following areas of FIG. 1. In addition, FIG. 1 illustrates a cut away cross sectional representation of the multilayered textile surface 1 and the constituent components of the multilayered textile surface 1 as follows. The plurality of conductive textile sewing filaments 111 in FIG. 1 extends through a portion of the multilayered textile surface 1, sufficient for the conduction of free electrons from the electrical ground 10 source to within either direct and/or field contact of the organism and said plurality of conductive textile sewing filaments 111, which may comprise a diverse plurality of conductive fibers, including but not limited to the plurality of carbon based fibrous threads 112. The plurality of carbon based fibrous threads 112 in FIG. 1 extends through a portion of the multilayered textile surface 1, in sufficient percentage so as to affect the requisite transfer of electrons from the electrically negative ground potential to the human in direct or field contact. FIG. 1 illustrates the substrate 103 of the multilayered textile surface 1 consisting of a plurality of fibers. A patch of conductive sewing filaments 4 in FIG. 1 illustrates a mechanical and conductive connection to the plurality of conductive textile sewing filaments 111 and the plurality of carbon based fibrous threads 112 of FIG. 1 and a mechanical connection with a portion of the multilayered textile surface 1, so as to be securely fastened upon and through the multilayered textile surface 1.

Figure 5:
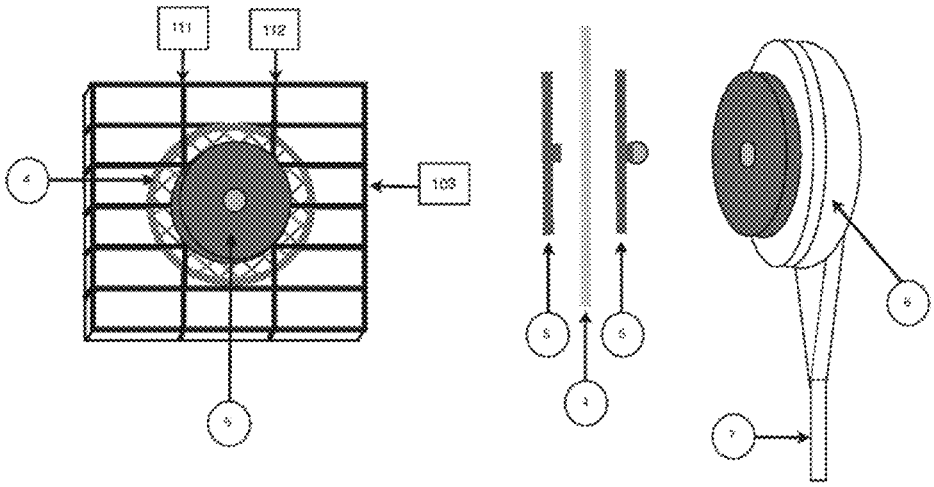
FIG. 5 is an enlarged cut away cross sectional representation of the multi-layered cover and additional constituent components of a preferred embodiment of the present invention and a removably attachable insulated conductive connector of a preferred embodiment of the present invention

Shown in FIG. 5 is an enlarged and perspective view of the following areas of FIG. 1. The plurality of conductive textile filaments 111 in FIG. 1 extends through a portion of the multilayered textile surface 1, sufficient for the conduction of free electrons from the electrical ground 10, sourced to within either direct or field contact of the organism and the plurality of conductive textile filaments 111, which comprises different kinds of conductive fibers such as, but not limited to, the plurality of carbon based fibrous threads 112. FIG. 1 illustrates the plurality of carbon based fibrous threads 112 extending through a portion of the multilayered textile surface 1 in sufficient percentage so as to affect the requisite transfer of electrons from the electrically negative ground potential to the human in direct or field contact. FIG. 1 illustrates the substrate 103 of the multilayered textile surface 1 consisting of a plurality of fibers. FIG. 1 illustrates a patch of conductive sewing filaments 4 in conductive connection to the plurality of conductive textile filaments 111 and the plurality of carbon based fibrous threads 112 and in mechanical connection with a portion of the multilayered textile surface 1, so as to be securely fastened upon and through the multilayered textile surface 1. In addition, FIG. 1 illustrates a male end 5 of an industry standard electrically conductive rivet 42, commonly deployed in the electro-static discharge (ESD) industry. The male end 5 of the electrically conductive rivet 42 is mechanically and conductively connected to and through the patch of conductive sewing filaments 4. FIG. 1 illustrates a female end 6 of the industry standard electrically conductive rivet 42, commonly deployed in the ESD industry, conductively and mechanically connectable to and detachable from the male end 5 of the industry standard electrically conductive rivet 42 and is conductively, mechanically, and selectively connected and insulated by an industry standard electrically conductive insulated wire 7. Moreover, FIG. 1 illustrates the industry standard electrically conductive insulated wire 7, commonly deployed in the ESD industry, that is conductively and mechanically connected to the female end 6 of the industry standard electrically conductive rivet 42, as well as conductively connected through and mechanically connected to an in-line fast blow fuse assembly employing an industry standard low resistance electrical device 8. The low resistance electrical device 8 acts as a sacrificial mechanism sufficient to provide overcurrent protection of the vertebrate organism, in this case a human.

Figure 6:
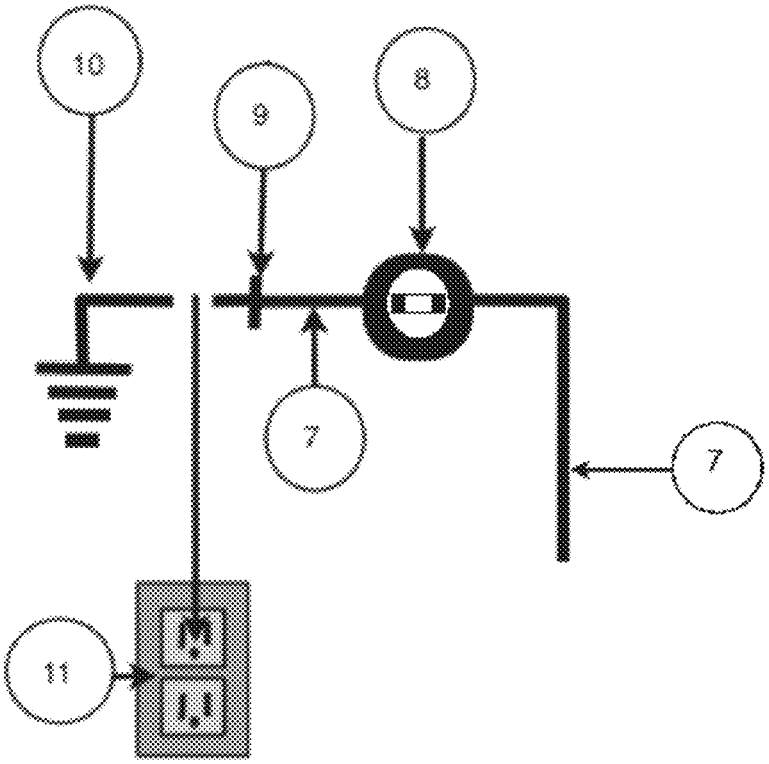
FIG. 6 is an enlarged and schematic representation of the wire and surge protector assembly of a preferred embodiment of the present invention.

Shown in FIG. 6 is an enlarged and perspective view of the following areas of FIG. 1. FIG. 1 illustrates the industry standard electrically conductive insulated wire 7, commonly deployed in the ESD industry, that is conductively and mechanically connected to the female end 6 of the industry standard electrically conductive rivet 42, as well as conductively connected through and mechanically connected to an industry standard inline fast blow fuse assembly employing the industry standard low resistance electrical device 8. The low resistance electrical device 8 acts as a sacrificial mechanism sufficient to provide over-current protection of the vertebrate organism, in this case a human, and is commonly deployed in the home electronics industry. The low resistance electrical device 8 is conductively and mechanically connected in-line to the electrically conductive insulated wire 7, as well as conductively and mechanically connected in-line to only the electrical ground prong of an industry standard wall plug 9, which is commonly deployed in the ESD industry and/or home electronics industry. FIG. 1 illustrates the industry standard wall plug 9 commonly deployed in the ESD industry and/or home electronics industry, that is conductively and mechanically connected to the electrically conductive insulated wire 7 and is conductively and mechanically removably connected to only the electrical ground 10 of a standard wall outlet 11. In addition, FIG. 1 illustrates any electrical ground 10. Furthermore, FIG. 1 illustrates the standard wall outlet 11 that is mechanically and conductively connected to the electric ground 10.

Although the invention has been explained in relation to its preferred embodiment, it is to be understood that many other possible modifications and variations can be made without departing from the spirit and scope of the invention as hereinafter claimed.

What is claimed is:

1. A sleep augmentation bed system comprises:

a multilayered textile surface, the multilayered textile surface comprises a stimulus responsive textile, a substrate, a plurality of conductive textile sewing filaments, and a plurality of carbon based fibrous threads;

the stimulus responsive textile being evenly disseminated through the substrate;

the plurality of conductive textile sewing filaments being evenly disseminated through the substrate;

the plurality of carbon based fibrous threads being evenly disseminated through the substrate; and the plurality of conductive textile sewing filaments and the plurality of carbon based fibrous threads being electrically coupled to a wall plug;

a patch of conductive sewing filaments;

an electrically conductive rivet;

an insulated wire;

the electrically conductive rivet comprises a male end and a female end;

the plurality of conductive textile sewing filaments and the plurality of carbon based fibrous threads being in electrical contact with the patch of conductive sewing filaments;

the patch of conductive sewing filaments being mounted into the multilayered textile surface by the male end;

the male end being detachably fastened to a female end;

the female end being electrically coupled to the wall plug through the insulated wire; and a low resistance electrical device is electrically integrated into the insulated wire between the female end and the wall plug.

2. The sleep augmentation bed system as claimed in claim 1 comprises:

a removable mattress surface;

a mattress;

the mattress being encircled by the removable mattress surface; and the multilayered textile surface being positioned onto and across the mattress.

3. The sleep augmentation bed system as claimed in claim 2 comprises:

a foundation;

the foundation being positioned contiguous to the mattress, opposite to the multilayered textile surface; and the mattress being mounted onto the foundation.

4. The sleep augmentation bed system as claimed in claim 2, wherein the multilayered textile surface is secured on the removable mattress surface by a first zipper assembly.

5. The sleep augmentation bed system as claimed in claim 2, wherein the removable mattress surface is sealed over the mattress by a second zipper assembly.

* * * * *